US008020739B2

(12) United States Patent
Blessing et al.

(10) Patent No.: US 8,020,739 B2
(45) Date of Patent: Sep. 20, 2011

(54) POSITIONING DEVICE WITH ACTUATING SWITCHING MEANS FOR A HAND-HELD SETTING TOOL

(75) Inventors: Matthias Blessing, Frastanz (AT); Markus Sprenger, Mauren (LI); Markus Kieber, Gamprin (LI)

(73) Assignee: Hilti Aktiengesellschaft, Schaan (LI)

( * ) Notice: Subject to any disclaimer, the term of this patent is extended or adjusted under 35 U.S.C. 154(b) by 157 days.

(21) Appl. No.: 11/977,042

(22) Filed: Oct. 22, 2007

(65) Prior Publication Data

US 2008/0099524 A1 May 1, 2008

(30) Foreign Application Priority Data

Oct. 27, 2006 (DE) ..... 10 2006 035 373

(51) Int. Cl.
*B25C 1/00* (2006.01)

(52) U.S. Cl. ..... 227/8; 227/156

(58) Field of Classification Search ..... 173/8–10; 42/70.09; 227/8–10, 156; 89/1.51
See application file for complete search history.

(56) References Cited

U.S. PATENT DOCUMENTS 908,982 A * 1/1909 Ely ..... 42/70.09
953,279 A * 3/1910 Moore ..... 42/70.01
2,766,451 A * 10/1956 Gannon ..... 227/9
3,060,435 A * 10/1962 Ivins et al. ..... 227/11
3,081,998 A * 3/1963 Weiss ..... 273/440
3,988,849 A * 11/1976 Connellan et al. ..... 42/70.09
4,452,387 A * 6/1984 Haytayan ..... 227/8
4,479,599 A 10/1984 Conrad
4,655,380 A * 4/1987 Haytayan ..... 227/9
5,465,893 A * 11/1995 Thompson ..... 227/8
5,924,229 A * 7/1999 Brice ..... 42/1.15
7,014,085 B2 * 3/2006 McCullough ..... 227/8
7,090,107 B2 * 8/2006 Buechel et al. ..... 227/8
7,565,991 B2 * 7/2009 Erhardt ..... 227/8
2003/0168491 A1 9/2003 Goodwin
2004/0245308 A1 * 12/2004 Arnold et al. ..... 227/10
2005/0011927 A1 * 1/2005 McCullough ..... 227/10
2005/0034989 A1 2/2005 Bogoev et al.
2005/0121487 A1 6/2005 Buechel et al.

* cited by examiner

*Primary Examiner* — Lindsay Low
(74) *Attorney, Agent, or Firm* — Abelman, Frayne & Schwab

(57) ABSTRACT

A positioning device for a hand-held setting tool (10) having an actuation switch (13) for actuating the setting tool (10), with the positioning device including a rod-shaped holder (21); a connection element (22) for the setting tool (10) arranged at an end of the holder (21), and an actuating switching device including an actuation element (24), a switching link (30) connecting an actuation element (24) to the actuation switch (13), and a safety device (40) for preventing actuation of the actuation switch (13) and having a gravity-controlled intermediate element (41) having an actuation position in which it is positioned between first controlling element (34) and second control element (35) of the switching link (30), and an interruption position (16) in which it interrupts the switching link (30).

15 Claims, 6 Drawing Sheets

POSITIONING DEVICE WITH ACTUATING SWITCHING MEANS FOR A HAND-HELD SETTING TOOL

BACKGROUND OF THE INVENTION

1. Field of the Invention

The present invention relates to a positioning device for a hand-held setting tool having an actuation switch for actuating the setting tool, with the positioning device including a rod-shaped holder defining a longitudinal axis, connection means for the setting tool arranged at an end of the holder, actuating switching means for actuating the actuation switch of the setting tool and including an actuation element, a switching link that connects the actuation element with the actuation switch of the setting tool, and a safety device for preventing actuation of the actuation switch of the setting tool at a predetermined orientation of the setting tool.

2. Description of the Prior Art

Positioning devices of the type described above are used, e.g., at overhead works with hand-held setting tools in case of high ceilings when working is possible only using working platforms or ladders. Setting tools, which can be used with such devices, can be driven with solid, gaseous, or liquid fuels or with compressed air or electricity.

U.S. Pat. No. 4,479,599 discloses a positioning and actuation device for a combustion-operated setting tool and including connection means for the setting tool, which is arranged at an end of an elongated holder and is formed as a rod or a bar. The rod or bar is axially displaceable relative to the connection means for actuating the actuation switch of the setting tool secured on the connection means via coupling means. For actuating the setting tool, the tool should be placed with its muzzle part against a ceiling and then be displaced in the direction of the ceiling with the holder or rod by the user.

Further, the positioning and actuation device has a safety device which prevents the setting tool from being actuated when the muzzle part is oriented exactly in direction of the force of gravity. For this purpose, the safety device has a ball which is guided in a channel extending in the connection means diagonally to the longitudinal axis of the rod and which rolls into the movement link of the rod when oriented in direction of the force of gravity, and prevents a further movement of the rod relative to the connection means and, therefore, prevents actuation of the setting tool secured on the connection means.

The drawback here consists in that the actuation of the setting tool can only be safely prevented when the positioning and actuation device with the setting tool is oriented exactly with the muzzle part facing in direction of the force of gravity.

U.S. Pat. No. 7,014,085 discloses an explosion-actuated setting tool having a housing, an elongated holder projecting therefrom, and a ball-controlled safety locking device which permits the setting tool to be actuated only in a vertical or almost vertical orientation opposite the force of gravity. The ball of the ball-controlled device is arranged in an annular receiving space between the holder and the housing.

However, the drawback of this setting tool consists in that high forces are applied when pressing on the parts which is required for the blocking function in the blocking position, and these forces can lead to wear over the course of time and can reduce the effectiveness of the safety locking device.

SUMMARY OF THE INVENTION

An object of the present invention is a positioning actuation device with actuating switching means of the type mentioned above which overcomes the drawbacks described above, operates in a trouble-free manner, and minimizes wear.

This and other objects of the present invention, which will become apparent hereinafter, are achieved by providing a positioning device for a hand-held setting tool having an actuation switch for actuating the setting tool of the type discussed above and in which the safety device has a gravity-controlled intermediate element positionable between a first controlling element and a second controlling element of the switching link. The intermediate element is positioned in an actively coupling manner between the first controlling element and the second controlling element in an actuation position, and interrupts the switching link in an interruption position. In the actuation position, the first controlling element and second controlling element can accordingly be coupled by the gravity-controlled intermediate element for conveying a switching movement, whereas in the interruption position coupling of the first controlling element and second controlling element is broken. Within the meaning of the invention, "gravity-controlled" means that the intermediate element is movable under the influence of a gravitational force when the position or orientation of the positioning device changes relative to the vector of the gravitational force.

Significant wear of the safety device need no longer be expected because no blocking structural components are provided which must absorb high pressing forces but, rather, an interruption of the switching link is merely carried out. In the disengaged position, the intermediate element is no longer within the flux of force of the switching link and is not loaded, nor is loaded the second controlling element or a subsequent portion of the switching link. On the other hand, the switching stroke of the first controlling element is not hindered but can be carried out freely and without resistance, without the flux of force reaching the second controlling element.

The first controlling element and the second controlling element are advantageously mounted in a guide channel provided in the holder so as to be displaceable along the longitudinal axis of the positioning device or holder so that the safety device can easily be integrated in the holder or in the connection means without jutting out radially.

Further, it is advantageous when, at least in an initial position of the holder, a free space for the intermediate element is provided in a housing part so as to extend radially circumferentially around an intermediate space between the first controlling element and the second controlling element. This results in a limiting angle that remains constant when the positioning device is lifted counter to the force of gravity until the intermediate element engages in the switching link and also when the positioning device is lowered in direction of the force of gravity until the intermediate element moves out of the switching link. Accordingly, the angle of inclination at which actuation is still possible is always the same, regardless of the movement of the positioning device previously described. The housing part can be part of the holder and/or part of the connection means.

Further, it is advantageous when the intermediate element is formed as a ball and the first controlling element has a depression for receiving the ball. In this way, the intermediate element can easily be moved by the force of gravity and, at the same time, effectively captured by the depression and held in position up to a predetermined angle of inclination.

In an advantageous embodiment, the depression is funnel-shaped and forms a funnel surface, and the funnel surface adjoins flush, on the radial outer side, a conical surface bordering the free space on the side remote from the second controlling element in the initial position of the holder. By means of this step, the intermediate element, which is formed as a ball, can easily be moved from the actuation position into the interruption position, and vice versa, without producing undesirable in-between positions of the ball.

In an advantageous embodiment of the ball-controlled safety device, the funnel surface forms a first angle to a normal to the longitudinal axis which corresponds, within a tolerance of ±2 degrees, to a second angle of the conical surface to the normal to the longitudinal axis. The first angle advantageously amounts to between 15° and 30° so as to make possible a maximum inclination of the positioning device to the vertical, also between 15° and 30°, at which the setting tool can still be actuated by the actuation element of the positioning device.

In an advantageous embodiment of the safety device, the intermediate element is formed as a pivotal body which is pivotally mounted at the second controlling element by a pivot connection. In this way, a small pressing force is provided because the maximum stroke of the switching link that is available for actuating the setting tool can be adjusted by selection of axial length of the pivotal body.

In an embodiment which can easily be converted in technical respects, the pivot connection is formed by a flexible bearing element which connects the pivotal body to the second controlling element. The pivotal body behaves like a pendulum and can pivot freely under the influence of the gravitational force. The flexible bearing element can be formed, e.g., as a thread or thin wire.

The pivotal body advantageously has a circumferentially extending conical sliding surface at its axial end opposite to the pivot connection, another circumferentially extending conical sliding surface being provided at the end of the first controlling element located opposite to this axial end. The design of the conical surfaces with respect to their cone angle relative to the axial extension is preferably carried out in such a way that the intermediate element and the first controlling element can slide past one another when the angle of inclination of the positioning device relative to the vertical is in a range from 15° to 30°, preferably 20°, resulting in a limiting angle in the range of 15° to 30°, preferably 20°, at which a setting process can still be actuated by the actuation element of the positioning device.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
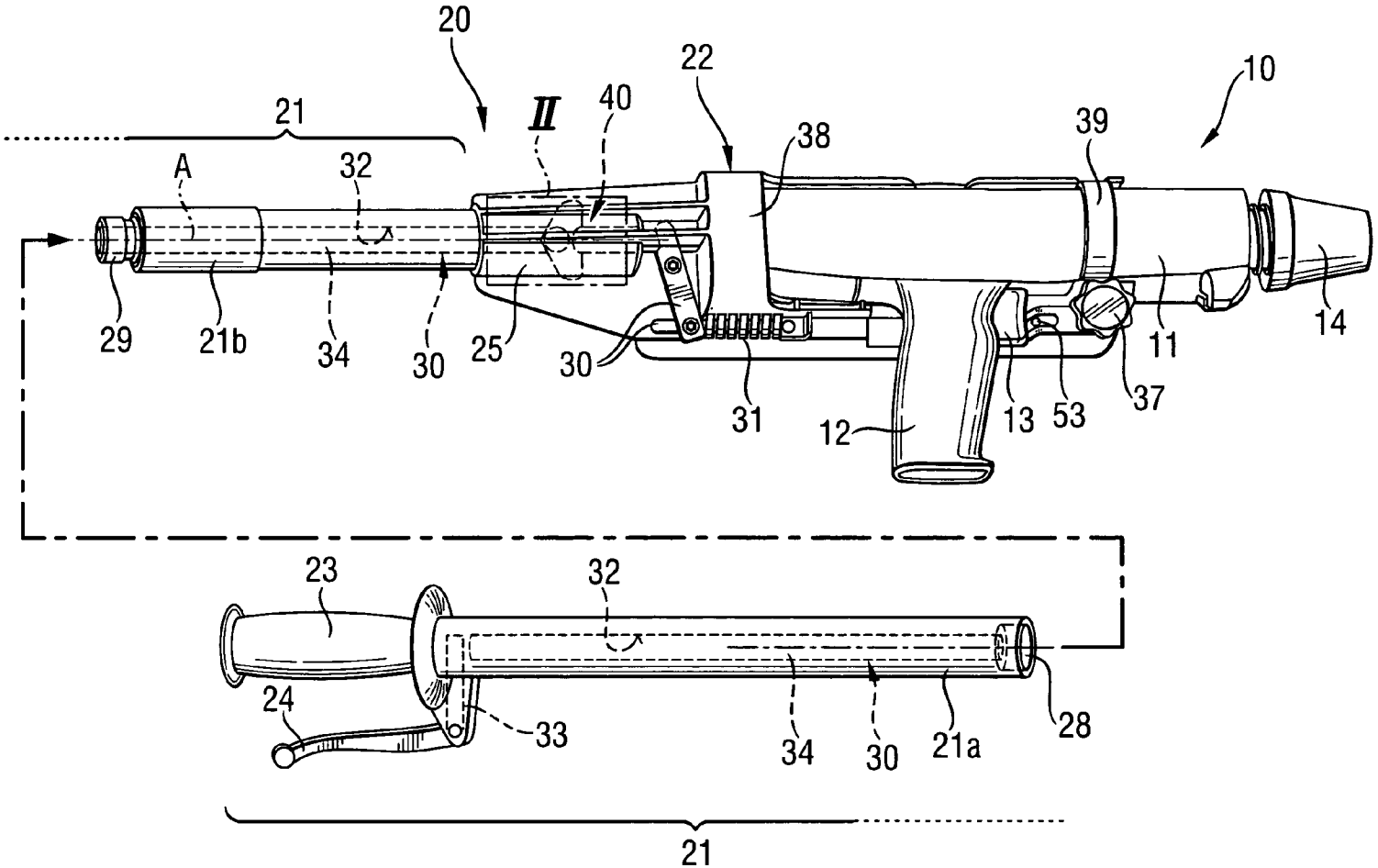
FIG. 1 a partially exploded view of the positioning device according to the invention with an actuating switching means and with a hand-held setting tool, which is arranged at connection means, in a non-pressed position.

FIGS. 1 to 4 show a positioning device 20 according to the invention with actuating switching means for a hand-held setting tool 10 and which can be formed a modular unit, for example. In the complete positioning device 20, the parts 21*a* and 21*b* of a rod-shaped holder 21, which are shown in FIG. 1 are coupled with one another by a coupling element 28 and a counter-coupling element 29. The connection between the coupling element 28 and the counter-coupling element 29 is detachable so that the positioning device 20 can be assembled and disassembled. One or more lengthening elements, not shown in the drawings, may be added between the two parts 21*a* and 21*b* of the rod-shaped holder 21. The longitudinal extension of the rod-shaped holder 21 defines a longitudinal axis A of the positioning device 20.

The setting tool 10 shown in FIG. 1 has a setting mechanism arranged in a housing 11 and having one or more parts for driving fastening elements into a constructional component. An actuation switch 13 is arranged at a holder 12 of the setting tool 10 for actuating a setting process. A muzzle part, designated in its entirety by 14, is arranged at the setting tool 10 in front of the housing 11 and can be displaced relative to the housing 11. When the muzzle part 14 of the setting tool 10 is pressed against a construction component (not shown in the drawings), the setting tool 10 changes to a ready state in which a setting process can be actuated by the actuation switch 13. The positioning device 20 has a switching link 30 by means of which the actuating switching means is connected with the actuation switch 13 of the setting 10. The actuating switching means includes an actuation element 24 of the rod-shape holder 21. Accordingly, the actuation element 24 acts as a remote actuation switch.

As can be seen from FIG. 1, the hand-held setting tool 10 is arranged at connection means 22 of the positioning device 20 and is reversibly secured thereto by first holding element 38 and second holding element 39. The setting tool 10 can be detached from the connection means 22 by loosening the screw means 37 of the second holding element 39.

At its end remote of the coupling element 28, the first part 21*a* of the rod-shape holder 21 has a grip part 23 and an actuation element 24 formed as an actuating lever. Alternatively, an actuating sleeve, for example, which is guided, e.g., at a supporting element of the holder 21 formed as a hollow rod and which would be displaceable relative to the supporting element parallel to the longitudinal axis A could be used instead of an actuating lever.

The actuation element 24 cooperates via an actuating member 33 with a rod-shaped first controlling element 34 formed of a plurality of parts (but shown as a two-part controlling element) of the switching link 30 which is guided in a guide channel 32 in the holder 21 so as to be displaceable (in parts 21*a* and 21*b*) and which extends into a housing part 25 of the connection means 22.

Figure 2:
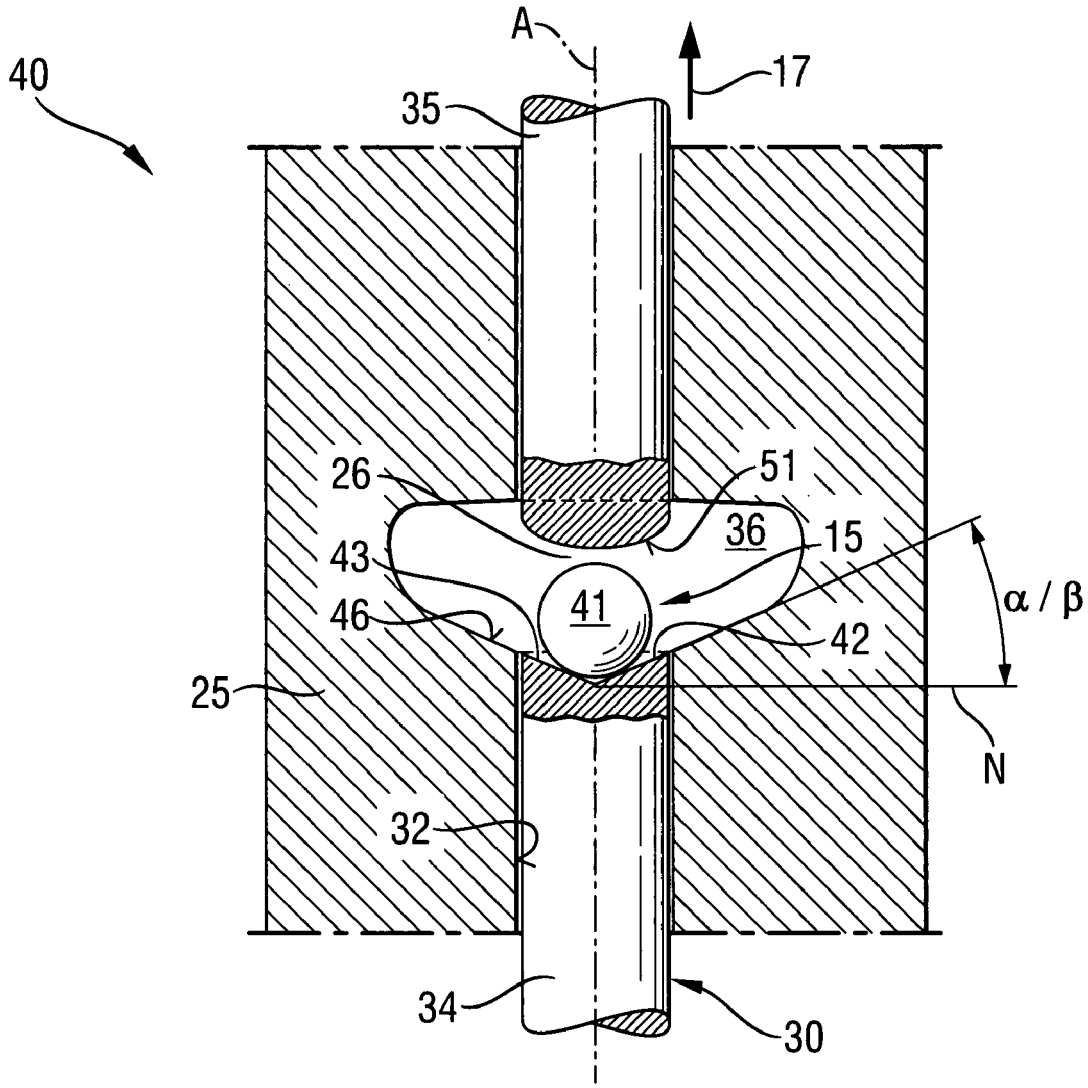
FIG. 2 a cross-sectional view of a detail of the positioning device according to the invention according to section II in FIG. 1 in the inactive position in a vertical orientation.
Figure 3:
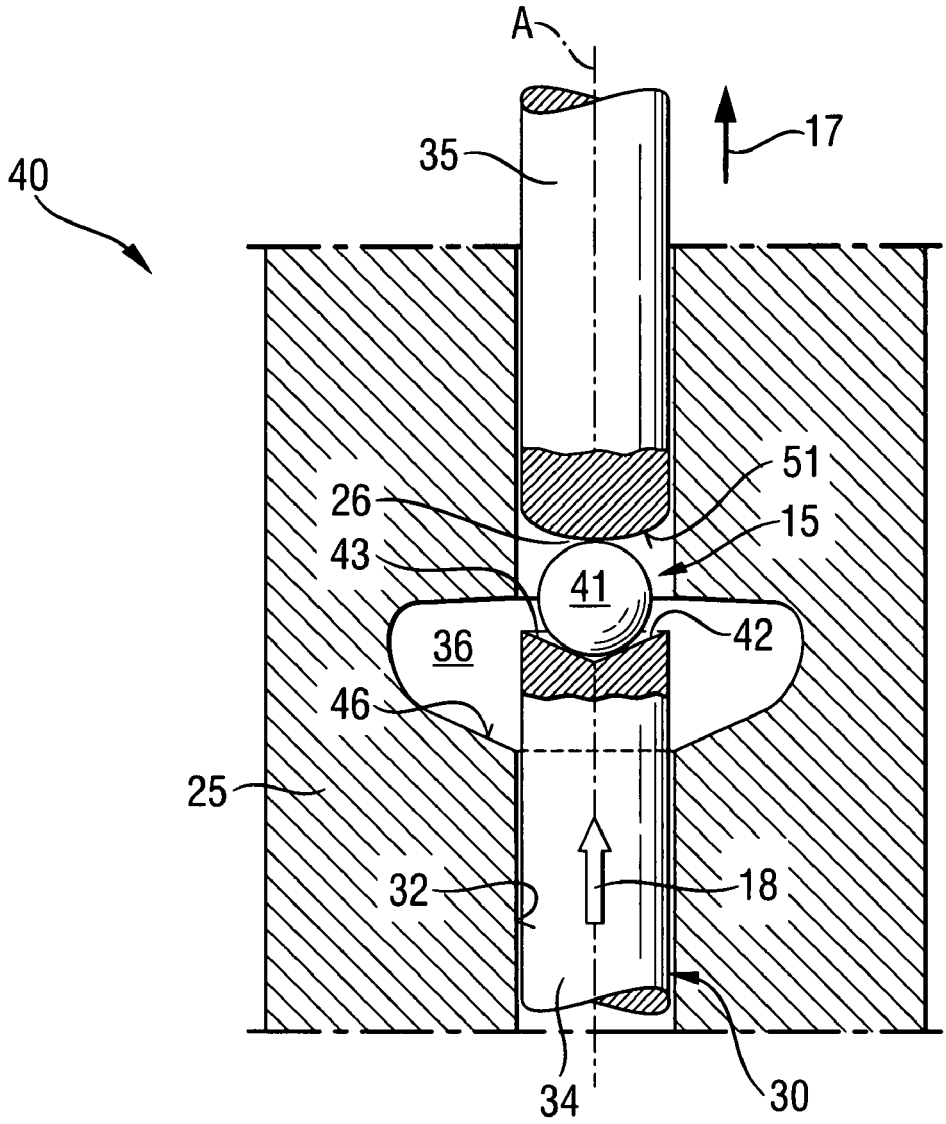
FIG. 3 a cross-sectional view of the detail of the positioning device shown in FIG. 2 in the actuated position.
Figure 4:
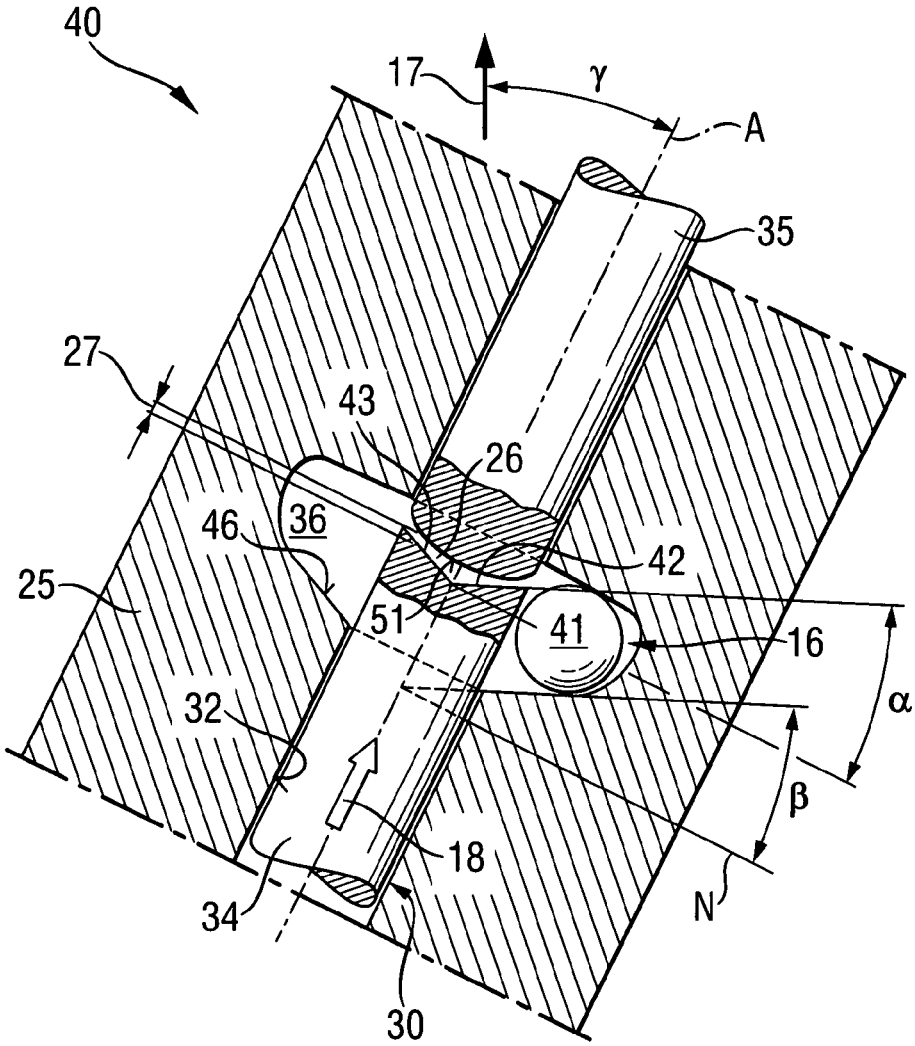
FIG. 4 a cross-sectional view of the detail of the positioning device shown in FIG. 2 oriented at an inclination of 26° to the vertical.

As can be seen from FIGS. 2 to 4, the switching link 30 also has a second rod-shape controlling element 35. Further, a driver 53 which cooperates with the actuation switch 13 of the setting tool 10 arranged at the connection means 22 is arranged at a free end of the switching link 30. At least the portion of the switching link 30 with the driver 53 is biased by a spring 31 in direction of its inactive position, shown in FIG. 1, in which the driver 53 does not press against the actuation switch 13 of the setting tool 10.

Further, the positioning device 20 has a safety device, designated in its entirety by 40, which prevents a setting tool 10 arranged at the positioning device 20 from being actuated by the element 24 in an orientation other than a predetermined orientation. For this purpose, an intermediate space 26 is provided between the first controlling element 34 and the second controlling element 35, and an intermediate element 41 of the safety device 40 can move into this intermediate space 26 to enable an actuation of the setting tool 10 by actuation of the actuation element 24. As can be seen particularly in FIG. 2, a free space 36 opening toward the guide channel 32 is arranged laterally around the intermediate space 26 at least in the initial position of the holder 21. When the positioning device 20 is oriented vertically, i.e., opposite to the action of gravitational force, as is shown in FIGS. 2 and 3, the intermediate element 41, which is formed as a ball in this embodiment, lies in a funnel-shaped depression 42 at the axial end of the first controlling element 34 facing the intermediate space. The depression 42 has a funnel surface 43 which, in the initial position of the holder 21 (FIG. 2), adjoins flush a conical surface 46 bordering the free space 36 in axial direction. In this position, the intermediate element 41 is in a actuation position 15 in which it is possible to actuate the setting tool 10 by actuating the actuation element 24 of the positioning device 20. The funnel surface 43 has a first angle $\alpha$ to a normal N to the longitudinal axis A of between 15° and 30° which corresponds, within a tolerance of about ±2°, to a second angle $\beta$ which is defined between the conical surface 46 and the normal N to the longitudinal axis A. By means of this design of the funnel surface 43, the intermediate element 41 or ball is still held in the depression 42 in a position inclined to the vertical at an inclination angle of less than approximately 15° to approximately 30° so that an actuation of the setting tool 10 by means of the actuation element 24 of the positioning device 20 is still possible in an orientation inclined to the vertical in this way. The angle $\alpha$ together with angle $\beta$ defines the limiting angle of the intermediate element 41, that is, the angle of inclination to the vertical starting from which the intermediate element 41 moves out of the intermediate space 26 and can accordingly exit from the actuation position 15 when the positioning device 20 is tilted toward the vertical by an angle of inclination $\gamma$ (see FIG. 4) exceeding this limiting angle.

In FIG. 3, the positioning device 20 with the setting tool 10 is in a vertical orientation which is indicated by the first arrow 17 and in which the muzzle part 14 of the setting tool 10 is oriented vertically opposite to the action of the force of gravity. The setting tool 10 is already pressed against a constructional component or ceiling, and the actuation element 24 has been actuated manually by the user (not shown in the drawing). The first controlling element 34 has been displaced in direction of the second arrow 18 by means of the actuating member 33 of the actuation element 24. This stroke movement is transmitted at least partially from the intermediate element 41, which is located in the actuation position 15 in the intermediate space 26 between the first controlling element 34 and the second controlling element 35, to the second controlling element 35 and then to the continued switching link 30 until it reaches the driver 53 for the actuation switch 13 at the setting tool (see FIG. 1). For this purpose, the second controlling element 35 has, at its end facing the intermediate space, a spherical head surface 51 whose radius of curvature is less than the limiting angle of the intermediate element 41 and less than angle $\alpha$, so that the intermediate element 41 or ball cannot be displaced laterally and the stroke movement of the first controlling element 34 can be reliably conveyed to the second controlling element 35.

In FIG. 4, the positioning device 20 with the setting tool 10 has been tilted by an angle of inclination $\gamma$ to the vertical (indicated by arrow 17). The angle of inclination $\gamma$ is greater than the first angle $\alpha$ defining the limiting angle of the intermediate element 41. Accordingly, the intermediate element 41, which is formed as a ball, rolls in a gravity-controlled manner on the oblique plane formed by the funnel surface 43 and the conical surface 46 into the free space 36, where it occupies its interruption position 16 for interrupting the switching link 30. When the actuation element 24 was actuated, the first controlling element 34 was moved in direction of the second arrow 18 by the actuating member 33, but this stroke movement was not transmitted to the second controlling element 35 because the first controlling element 34 was no longer in operative communication with the second controlling element 35 via the intermediate element 41. Rather, a gap 27 remains between the two controlling elements 34, 35 even after the stroke movement of the first controlling element 34 in the direction of the arrow 18. Accordingly, in this interruption position 16 of the intermediate element 41 of the safety device 40, the setting tool can no longer be actuated by the actuation element 24 of the positioning device 20.

Figure 5:
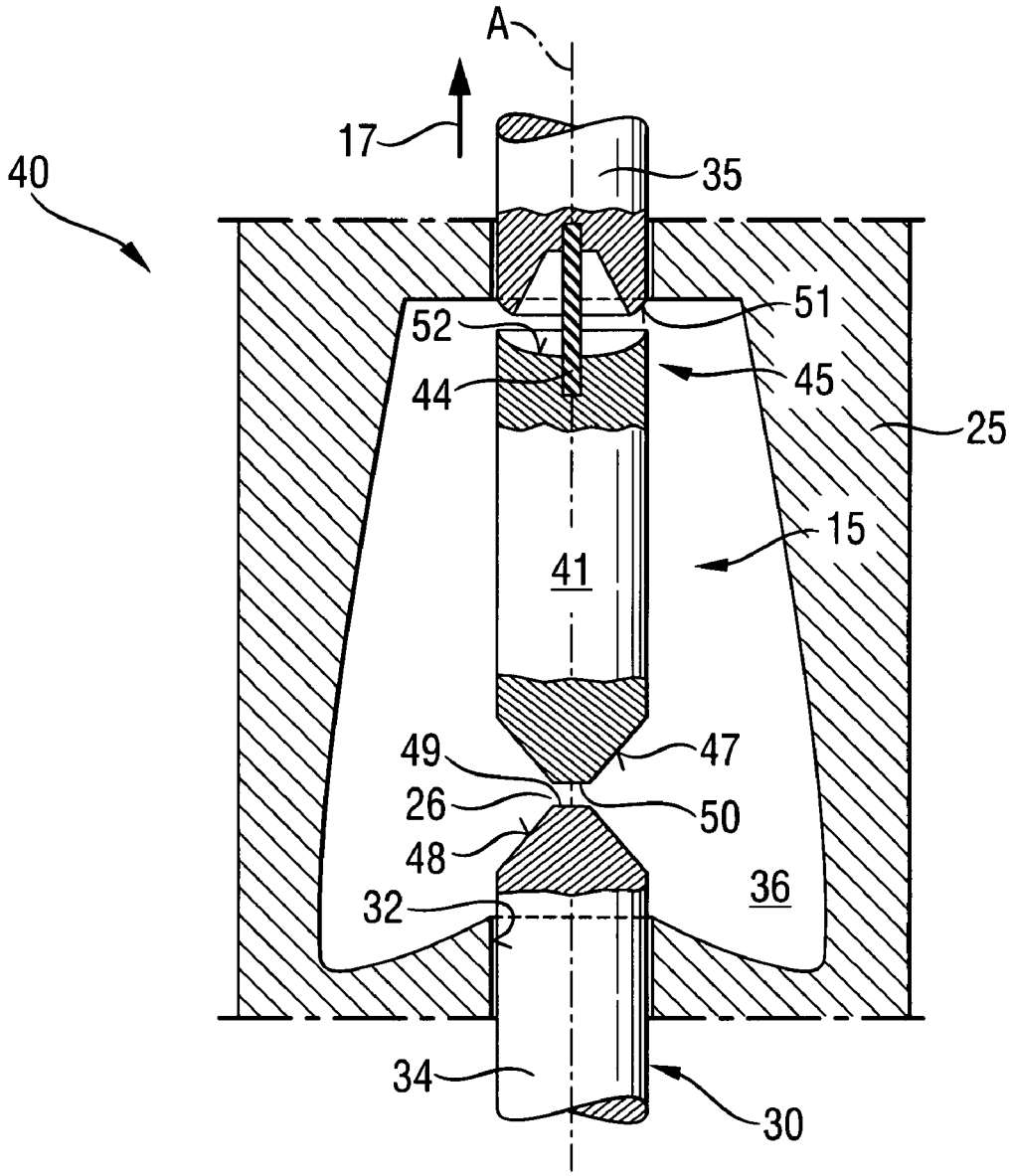
FIG. 5 a cross-sectional view of a detail of another positioning device according to the invention with an actuating switching means and corresponding to section II in FIG. 1 in the inactive position in a vertical orientation.
Figure 6:
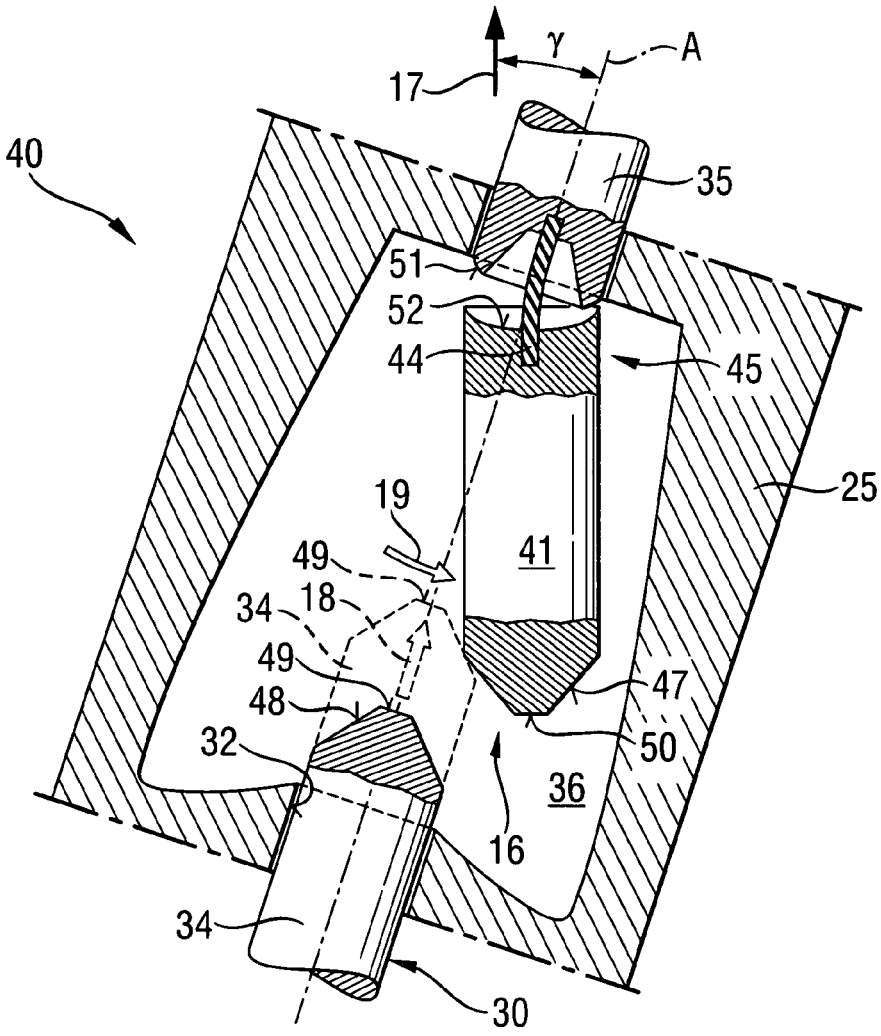
FIG. 6 a cross-sectional view of the detail of the positioning device shown in FIG. 5 oriented at an inclination of approximately 18° to a vertical.

FIGS. 5 and 6 show a variant of a safety device 40 according to the invention for the positioning device 20 from FIG. 1. This safety device 40 differs from the safety device 40 described above with reference to FIGS. 2 to 4 in that the intermediate element 41 is formed as a pivotal body which is mounted at the second controlling element 35 via a pivotal connection 45. The pivot connection 45 is formed by a flexible bearing element 44 which connects the pivotal body to the second controlling element 35. Instead of a flexible bearing element 44, the pivot connection 45 can also be formed, for example, by a pivot-support, e.g., a ball joint support, which is arranged between the second controlling element 35 and the pivotal body. The intermediate element 41 or pivotal body has a circumferential conical sliding surface 47 at its axial end opposite the pivotal connection 45, and another circumferential conical sliding surface 48 is provided at the end of the first controlling element 34 located opposite this axial end. The conical sliding surfaces 47, 48 end, respectively, in a first head surface 49 and a second head surface 50. The conical sliding surfaces 47, 48, with respect to their cone angle, and the first head surface 49 and second head surface 50, with respect to their surface area, are preferably designed in such a way that the intermediate element 41 and the first controlling element 34 can slide past one another, proceeding from an angle of inclination of the positioning device in the range of 15° to 30°, preferably 20°, to the vertical as limiting angle and can accordingly occupy the interruption position 16 (see FIG. 6). At an angle of inclination less than the limiting angle in the range of 15° to 30°, or preferably 20°, the pivotal body is located in the actuation position 15 (see FIG. 5). As can be seen from FIG. 5, the first head surface 49 of the first controlling element 34 is located at least partially opposite from the second head surface 50 of the intermediate element 41 or pivotal body along the longitudinal axis A in the actuation position 15. Therefore, when the actuation element 24 is actuated manually, a stroke movement of the first controlling element 34 can be transmitted by the intermediate element 41 to the second controlling element 35 and, accordingly, via the continued switching link 30, to the driver 53 so that the setting 10 can be remotely actuated at the connection means 22. For this purpose, the intermediate element 41 has an axial end face 52 at its axial end facing the pivotal connection 45, which axial end face 52 is curved in a concave manner and can be brought into contact at least partially with the second controlling element 35 by the spherically curved head surface 51 in the actuation position 15. The end of the second controlling element 35 with the spherical head surface 51 has a bell-shaped recess to facilitate the pendulum motion of the flexible bearing element 44.

However, when the positioning device 20 is inclined at an angle of inclination γ relative to the vertical (indicated by the first arrow 17) which is greater than the limiting angle, as is shown in FIG. 6, the pivotal body or the intermediate element 41 swivels out of the intermediate space 26 under the influence of gravitational force in the direction of the third arrow 19 until it occupies the interruption position 16. When the first controlling element 34 is actuated by means of the actuation element 24 and the actuating member 33 and moves in the direction of the second arrow 18 (shown in dashes), the first controlling element 34 and the intermediate element 41 run past one another at the conical sliding surfaces 47, 48, without an actuation of the second controlling element 35 taking place. Rather, the intermediate element 41 can be pivoted farther to the side by the moving first controlling element 34. The switching link is accordingly interrupted.

With respect to further reference numbers not discussed in detail in connection with FIGS. 5 and 6, reference is made to the preceding description of FIGS. 1 to 4 in its entirety.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A positioning device for a hand-held setting tool (10) having an actuation switch (13) for actuating the setting tool (10), the positioning device comprising a rod-shaped holder (21) for supporting the setting tool; connection means (22) for connecting the positioning device with the setting tool (10) arranged at an end of the holder (21); and an actuating switching device including an actuation element (24), a switching link (30) for connecting the actuation element (24) to the actuation switch (13) of the setting tool (10) and having first (34) and second (35) rod-shaped controlling elements arranged coaxially with each other and spaced from each other and associated, respectively, with the actuation element (24) and the actuation switch (13) for actuating the actuation switch (13) of the setting tool (10) in response to actuation of the actuation element (24), and a safety device (40) for preventing actuation of the actuation switch (13) at a predetermined orientation of the setting tool (10), the safety device (40) having a gravity-controlled intermediate element (41) displaceable between an actuation position in which it is positioned in a space region between the first controlling element (34) and the second controlling element (35) for transmitting a switching movement from the first controlling element (34) to the second controlling element (35) and an interruption position (16) in which it is unable to transmit the switching movement from the first controlling element (34) to the second controlling element (35).

2. A positioning device according to claim 1, wherein the holder (21) has a guide channel (32) extending along a longitudinal axis (A) of the rod-shaped holder (21), and wherein the first controlling element (34) and the second controlling element (35) are mounted in the guide channel (32) for displacement along the longitudinal axis (A).

3. A positioning device according to claim 1, wherein a free space (36) is provided in a housing part (25) that extends radially circumferentially around an intermediate space (26) between the first controlling element (34) and the second controlling element (35) at least in an initial position of the holder (21) for accommodating the intermediate element (41) in the interruption position thereof.

4. A positioning device for a hand-held setting tool (10) having an actuation switch (13) for actuating the setting tool (10), the positioning device comprising a rod-shaped holder (21) for supporting the setting tool; connection means (22) for connecting the positioning device with the setting tool (10) arranged at an end of the holder (21); and an actuating switching device including an actuation element (24), a switching link (30) for connecting the actuation element (24) to the actuation switch (13) of the setting tool (10) and having first (34) and second (35) controlling elements located on a longitudinal axis (A) of the rod-shaped holder in a spaced relationship to each other and associated, respectively, with the actuation element (24) and the actuation switch (13) for actuating the actuation switch (13) of the setting tool (10) in response to actuation of the actuation element (24), and a safety device (40) for preventing actuation of the actuation switch (13) at a predetermined orientation of the setting tool (10), the safety device (40) having a gravity-controlled intermediate element (41) displaceable between an actuation position in which it is positioned on the longitudinal axis (A) between the first controlling element (34) and the second controlling element (35) for transmitting a switching movement from the first controlling element (34) to the second controlling element (35), and an interruption position (16) in which it is unable to transmit the switching movement from the first controlling element (34) to the second controlling element (35).

5. A positioning device according to claim 4, wherein the holder (21) has a guide channel (32) extending along the longitudinal axis (A), and wherein the first controlling element (34) and the second controlling element (35) are mounted in the guide channel (32) for displacement along the longitudinal axis (A).

6. A positioning device according to claim 4, wherein a free space (36) is provided in a housing part (25) that extends radially circumferentially around an intermediate space (26) between the first controlling element (34) and the second controlling element (35) at least in an initial position of the holder (21) for accommodating the intermediate element (41) in the interruption position thereof.

7. A positioning device according to claim 1, wherein the intermediate element (41) is formed as a ball, and the first controlling element (34) has a depression (42) for receiving the ball.

8. A positioning device according to claim 1, wherein the intermediate element (41) is formed as a pivotal body which is pivotally mounted to the second controlling element (35) by a pivot connection (45).

9. A positioning device according to claim 4, wherein the intermediate element (41) is formed as a ball, and the first controlling element (34) has a depression (42) for receiving the ball.

10. A positioning device according to claim 9, wherein the depression (42) is funnel-shaped and forms a funnel surface (43), and wherein the funnel surface (43) adjoins flush a radial outer side with a conical surface (46) bordering a free space (36) on a side thereof remote from the second controlling element (35) in the initial position of the holder (21).

11. A positioning device according to claim 10, wherein the funnel surface (43) forms a first angle ($\alpha$) to a normal (N) to the longitudinal axis (A) which corresponds, within a tolerance of ±2 degrees, to a second angle ($\beta$) of the conical surface (46) to the normal (N) to the longitudinal axis (A).

12. A positioning device according to claim 11, wherein the first angle ($\alpha$) amounts to between 15° and 30°.

13. A positioning device according to claim 4, wherein the intermediate element (41) is formed as a pivotal body which is pivotally mounted to the second controlling element (35) by a pivot connection (45).

14. A positioning device according to claim 13, wherein the pivot connection (45) is formed by a flexible bearing element (44) which connects the pivotal body directly to the second controlling element (35).

15. A positioning device according to claim 13, wherein the pivotal body has a circumferentially extending conical sliding surface (47) at its axial end opposite the pivot connection (45), and another circumferentially extending conical sliding surface (48) is provided at the end of the first controlling element (34) located opposite to the axial end.

* * * * *